US005245973A

United States Patent [19]

Otsuka et al.

[11] Patent Number: 5,245,973

[45] Date of Patent: Sep. 21, 1993

[54] FAILURE DETECTION DEVICE FOR EVAPORATIVE FUEL PURGE SYSTEM

[75] Inventors: Takayuki Otsuka, Susono; Nobuaki Kayanuma, Gotenba, both of Japan

[73] Assignee: Toyota Jidosha Kabushiki Kaisha, Toyota, Japan

[21] Appl. No.: 867,148

[22] Filed: Apr. 10, 1992

[30] Foreign Application Priority Data

| | | | |
|---|---|---|---|
| Apr. 18, 1991 | [JP] | Japan | 3-086908 |
| Dec. 6, 1991 | [JP] | Japan | 3-323364 |
| Jan. 20, 1992 | [JP] | Japan | 4-007753 |

[51] Int. Cl.[5] ..... F02M 33/02

[52] U.S. Cl. ..... 123/518; 123/519; 123/198 D

[58] Field of Search ..... 123/516, 518, 519, 520, 123/198 D

[56] References Cited

U.S. PATENT DOCUMENTS

| | | | |
|---|---|---|---|
| 4,331,120 | 5/1982 | Hiramatu et al. | 123/519 |
| 4,386,947 | 6/1983 | Mizuno et al. | 123/519 |
| 4,750,465 | 6/1988 | Rediker, Jr. et al. | 123/519 |
| 4,949,695 | 8/1990 | Uranishi et al. | 123/520 |
| 5,054,454 | 10/1991 | Hamburg | 123/520 |
| 5,056,494 | 10/1991 | Kayanuma | 123/519 |
| 5,085,197 | 2/1992 | Mader et al. | 123/520 |
| 5,111,796 | 5/1992 | Ogita | 123/518 |
| 5,143,035 | 9/1992 | Kayanuma | 123/520 |
| 5,146,902 | 9/1992 | Cook et al. | 123/519 |
| 5,150,689 | 9/1992 | Yano et al. | 123/519 |
| 5,158,054 | 10/1992 | Otwuka | 123/198 D |
| 5,174,265 | 12/1992 | Sekine | 123/516 |

FOREIGN PATENT DOCUMENTS

| | | |
|---|---|---|
| 26754 | 2/1990 | Japan . |
| 102360 | 4/1990 | Japan . |
| 130255 | 5/1990 | Japan . |

*Primary Examiner*—E. Rollins Cross
*Assistant Examiner*—Thomas Moulis
*Attorney, Agent, or Firm*—Kenyon & Kenyon

[57] ABSTRACT

A failure detection device that detects a failure occurring in an evaporative fuel purge system by detecting the pressure inside a vapor passage and a purge passage. The vapor passage and the purge passage are connected via a bypass passage. A pressure sensor is connected to either the vapor passage or the purge passage. An engine control unit is provided which judges that a failure has occurred in the evaporative fuel purge system when the pressure sensor detects a pressure equal to or higher than the predetermined pressure.

11 Claims, 9 Drawing Sheets

FAILURE DETECTION DEVICE FOR EVAPORATIVE FUEL PURGE SYSTEM

BACKGROUND OF THE INVENTION (1) Field of the Invention

The present invention generally relates to failure detection devices for evaporative fuel purge systems, and more particularly to a failure detection device for an evaporative fuel purge system which device detects a failure of passage in an evaporative fuel purge system by detecting pressure of an evaporative fuel in the passage.

(2) Description of the Related Art

Generally, the fuel vapor evaporated in the fuel tank is adsorbed by the adsorbent in the canister so as to prevent the fuel from escaping into the atmosphere. However, the amount of fuel adsorbed in the canister is limited because the capacity of the canister is limited. Therefore, there is a purge system for fuel vapor which purges the fuel vapor adsorbed in the canister to an intake line of the engine in order to prevent overflow of fuel in the canister. The fuel vapor flows through the purge passage connecting the canister with the intake line of the engine and is purged to the inside of the intake line by a vacuum pressure generated by the engine operation. A purge control valve is usually provided to the purge passage to control the timing of the purge.

In this evaporative fuel purge system, there is a possibility that the fuel in the canister overflows or the fuel leaks to the atmosphere when the failure such as a fracture or a disconnection of the vapor line occurs. For this reason, an evaporative fuel purge system having a self diagnosis device for failures is suggested.

Conventionally, such an evaporative fuel purge system is disclosed in, for example, Japanese Laid-Open Patent Application No. 2-130255. The failure detection system disclosed in the Patent Publication above is for detecting a failure of the evaporative fuel purge system on the basis of a pressure change obtained, during purging, and before and after operation of the purge control valve, by providing a pressure sensor positioned between the canister and purge control valve on the vapor line.

However, in the aforementioned conventional device, there is a problem in that the failure can not be detected in case the failure occurs in the vapor passage which extending from the fuel tank to the canister, because the pressure sensor is provided in the purge passage.

Then detecting failure of the vapor passage as well as the purge passage, a pressure sensor is required in the vapor passage in addition to the pressure sensor in the purge passage; this results in an increase of the number of parts and in the complexity of the construction.

Moreover, there is a problem in that the construction of the failure detection means, which detects a failure on the basis of the signal from the pressure sensor, becomes complex.

SUMMARY OF THE INVENTION

It is a general object of the present invention to provide a novel and useful failure detection device for an evaporative fuel purge system in which the above-mentioned problems are eliminated.

A more specific object of the present invention is to provide a detection device for an evaporative fuel vapor purge system in which a failure occurring in either the purge passage or the vapor passage can be detected by means of a single pressure sensor.

A further object of the present invention is to provide a failure detection device for an evaporative fuel purge system in which failure can be detected by a failure detection device of simple construction.

The above-mentioned objects of the present invention are achieved by a failure detection device for an evaporative fuel purge systems comprising:

- a canister for containing an adsorbent for adsorbing a fuel vapor;
- a vapor passage, connecting the canister to a fuel tank, for introducing to the canister a fuel vapor in the fuel tank;
- a purge passage for introducing the fuel vapor adsorbed by the adsorbent in the canister to an intake line of an internal combustion engine;
- a bypass passage for connecting the vapor passage and the purge passage;
- detection means, provided in either the purge passage or the vapor passage, for detecting the pressure therein; and
- judging means for judging that a failure has occurred when the detection means detects a pressure higher than a predetermined pressure while the fuel vapor is purged to the intake line of the internal combustion engine.

According to the failure detection device mentioned above, a failure of an entire evaporative fuel purge system, including a vapor passage, can be detected by means of a single pressure sensor by having the vapor passage and the purge passage connected to each other. Accordingly, simplicity of construction for a failure detection device can be obtained.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
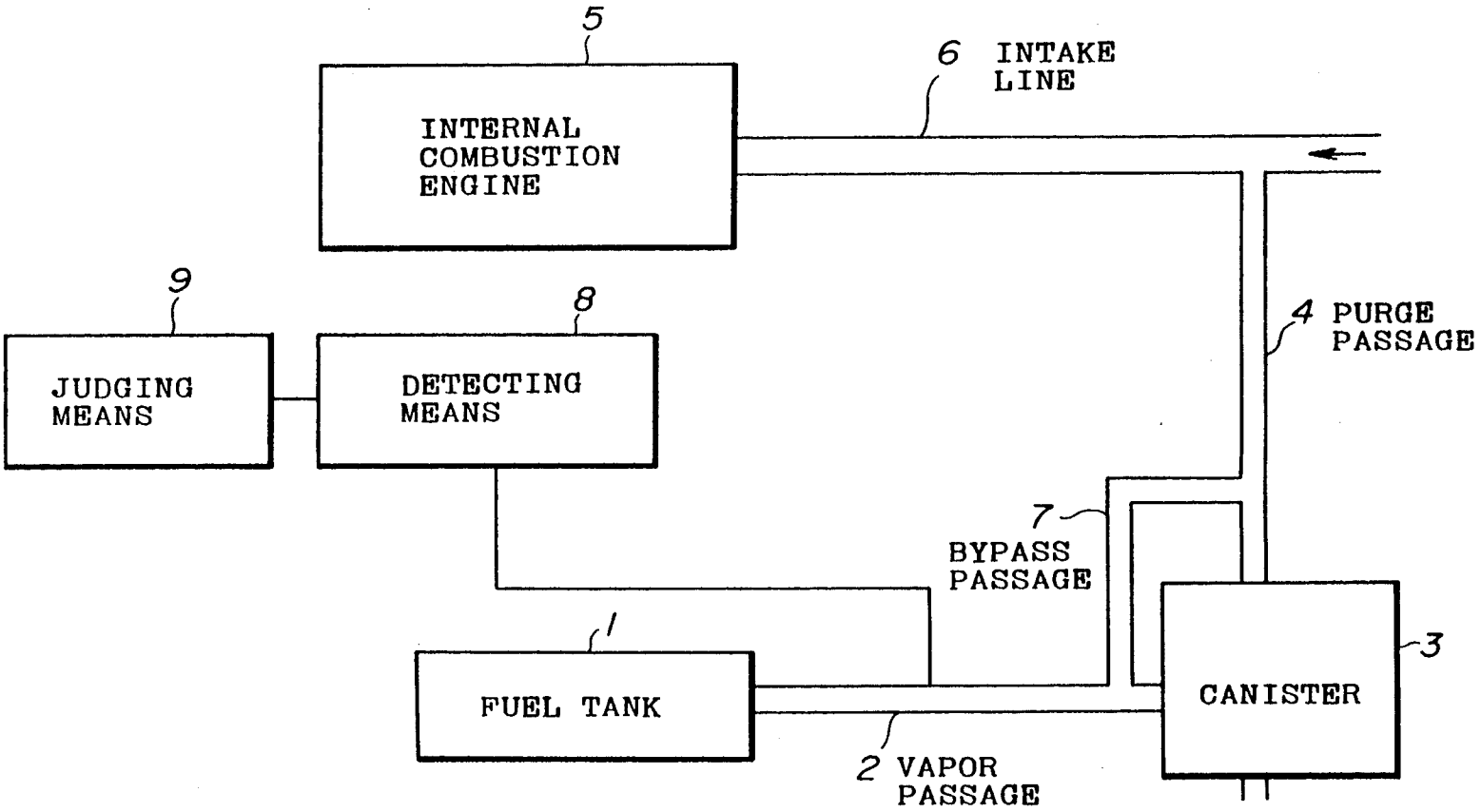
FIG. 1 is a block diagram for explaining the construction of the present invention.

FIG. 1 shows a principle of construction for the failure detection device for an evaporative fuel purge system according to the present invention. Fuel vapor from the fuel tank 1 flows through the vapor passage 2 and is adsorbed by the adsorbent in the canister 3. Adsorbed fuel in the canister 3 is led to the intake line 6 of the internal combustion engine 5 via the purge passage 4, and is purged to the inside of the intake line 4. In the construction above, the failure detection device according to the present invention features a construction comprising the bypass passage 7 and the detecting means 8 and judging means 9.

The bypass passage 7 above communicates the vapor passage 2 and the purge passage 4; accordingly, the pressure inside the vapor passage 2 and the purge passage 4 become equal. The detecting means 8 measures the pressure inside the vapor passage 2 on the basis of the signal from the judging means 9, and then sends the obtained pressure value to the judging means 9. The judging means 9 judges whether or not a failure exists in the evaporative fuel purge system, by comparing the obtained pressure value with a predetermined pressure value.

Figure 2:
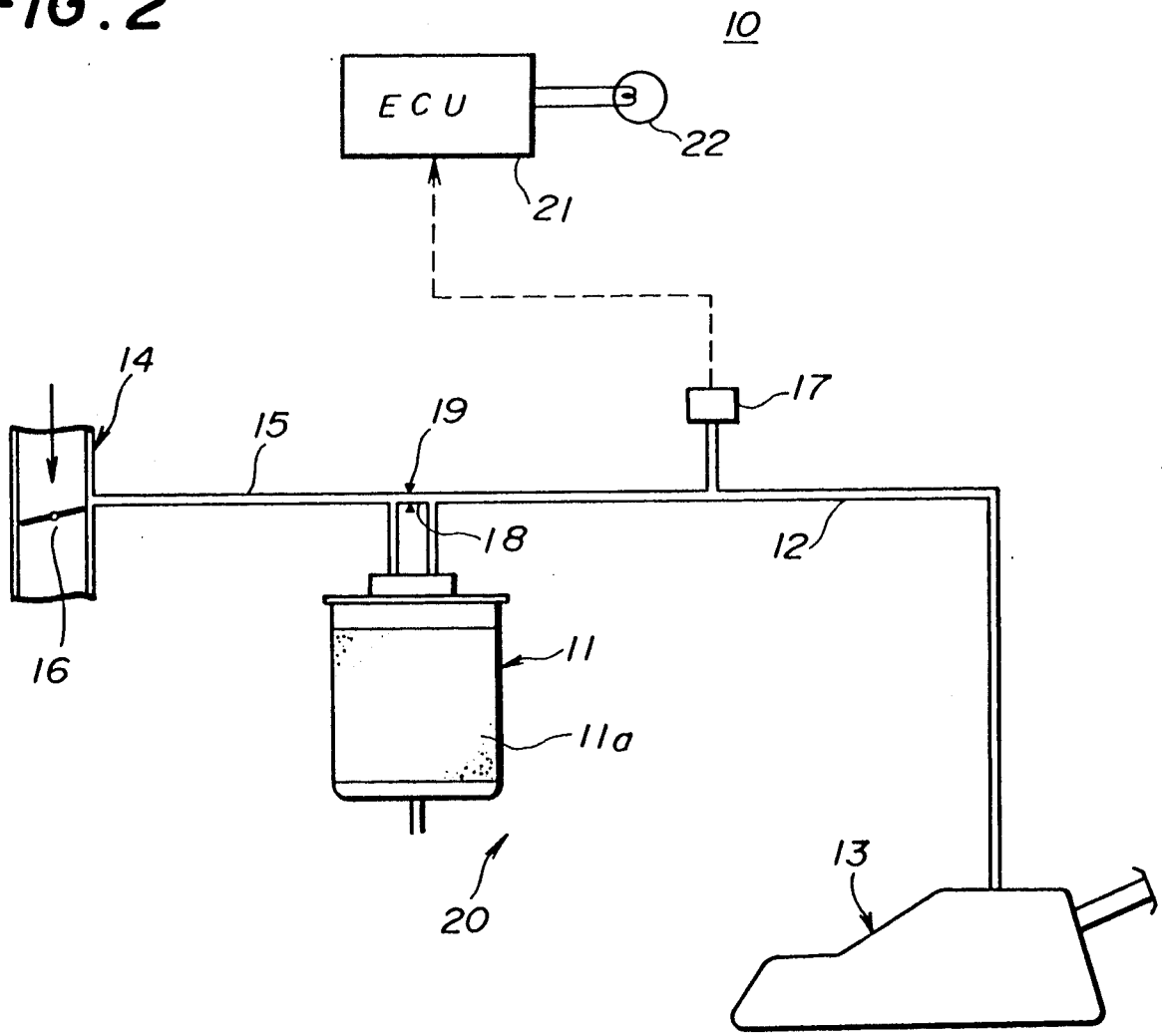
FIG. 2 is a view showing a first embodiment of the failure detection device for an evaporative fuel purge system according to the present invention.

FIG. 2 shows the failure detection device 10 for an evaporative fuel purge system of the first embodiment according to the present invention.

In the drawing, the canister 11 is filled with an adsorbent such as activated carbon, and can adsorb a fuel vapor. This canister 11 is connected to the fuel tank 13 by the vapor passage 12. The fuel vapor evaporated in the fuel tank 13 is introduced to the canister 11 via the vapor passage 12, and is kept in the canister 11 by virtue of being adsorbed by the adsorbent 11*a*. The purge passage 15 is provided between the canister 11 and the intake line 14 of the internal combustion engine. This purge passage 15 communicates with a downstream portion of the throttle valve along the intake line 14 when the opening of the throttle valve 16, positioned in the intake line, exceeds a predetermined value. The evaporative fuel purge system 20 comprises the canister 11, the vapor passage 12, the fuel tank 13, the intake line 14 and the purge passage 15 mentioned above.

The failure detection device 10 according to the present invention includes the pressure sensor 17 in the vapor passage 12, and connecting the vapor passage 12 to the purge passage 15 as mentioned above. The bypass passage 18 which connects the vapor passage 12 and the purge passage 15 is provided above the canister 11. The orifice 19 is provided to the bypass passage 18. The pressure sensor 17 is connected to the engine control unit (ECU) 21.

The operation of the evaporative fuel purge system 20 as mentioned above is explained hereinafter.

In the evaporative fuel purge system above, when the fuel evaporates in the fuel tank 13, the evaporated fuel (hereinafter called fuel vapor) flows through the vapor passage 12 and reaches the bypass passage 18. Since the orifice 19 provided in the bypass passage 18 has high fluid resistance, most of the fuel vapor flows into the canister, which has lower fluid resistance, and is adsorbed to the adsorbent 11*a*.

The purge of the fuel adsorbed in the canister 11 is executed as follows. When the throttle valve 16 in the intake line 14 is opened, a negative pressure is applied to the purge passage 15 as the air entering the intake line flows in the direction indicated by the arrow in FIG. 2. This negative pressure in the purge passage 15 is lead to the vapor passage 12 via the orifice 19 and the canister 11. As mentioned above, the fluid resistance of the bypass passage 18 is higher than that of the passage to the canister 11 because of the orifice 19 positioned in the bypass passage 18. Therefore, the fuel adsorbed in the canister 11 passes through the purge passage 15 and is purged to the intake line 14. Following the steps mentioned above, the evaporative fuel purge system 20 has the fuel vapor generated in the fuel tank 13 adsorbed in the canister 11 and the fuel in the canister 11 purged to the intake line 14. Therefore, the existence of the bypass passage 18 does not at all affect the basic operation of the evaporative fuel purge system 20.

The reason for providing the orifice 19 to the bypass passage 18, and connecting the pressure sensor to an upstream portion of the orifice 19 (the fuel tank side) is that if the orifice is not provided, a uniform negative pressure is applied to the entire system. However, when such an orifice is provided, the upstream of the orifice becomes a virtually static pressure system due to the high fluid resistance of the orifice. In other words, fluctuation of the pressure value obtained from the pressure sensor 17 connected to the upstream of the orifice is reduced when the pressure of the downstream portion of the orifice fluctuates. Therefore, providing the orifice and connecting the pressure sensor to the upstream of the orifice (the fuel tank side) makes it possible to obtain higher accuracy in detection of the failure.

Following is an explanation of the operation of the failure detection device 10.

Figure 3:
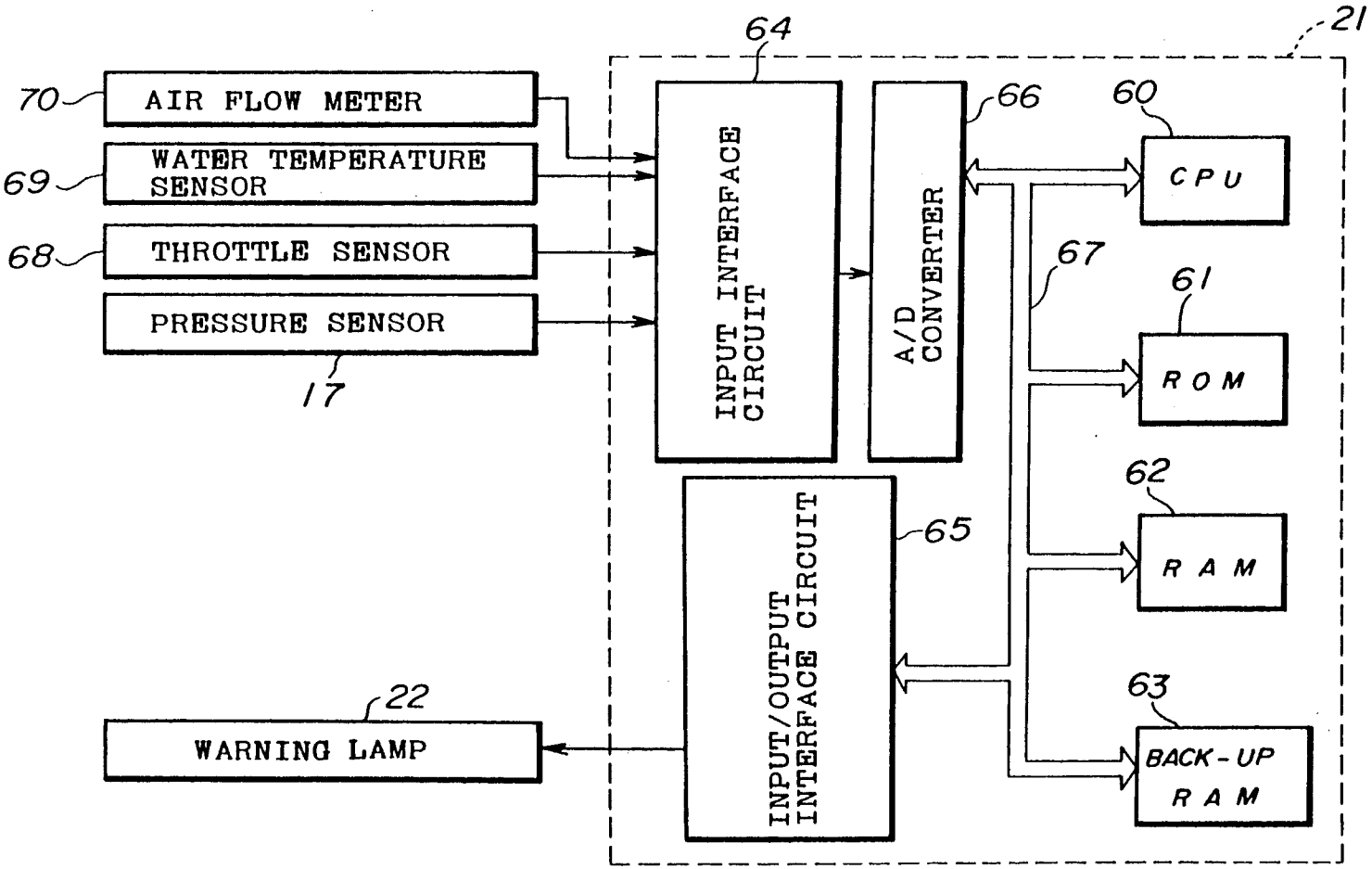
FIG. 3 is a block chart for explaining the engine control unit (ECU) shown in FIG. 2.

The operation of the failure detection by the failure detection device 10 is executed by the program of the ECU 21. This ECU 21, comprising a microcomputer, includes known hardware shown in FIG. 3. In FIG. 3, those parts that are the same as corresponding parts in FIG. 2 are designated by the same reference numerals, and descriptions thereof will be omitted. In FIG. 3, the ECU 21 comprises the central processing unit (CPU) 60, the read only memory (ROM) 61 including the program for the operation, the random access memory (RAM) 62 used as a processing area, the backup RAM 63 storing the data after the engine stops, the input interface circuit 64, and the A/D converter with multiplexer 66 and input/output interface circuit 65. These components are connected to each other via the bus 67.

The A/D converter 66 receives signals, such as the signal from the pressure sensor 17, through the input interface circuit 64 and, after analog/digital conversion, sends the signal to the bus 67. The input/output interface circuit 65 sends the control signal to the warning lamp 22 so as to control it.

Various sensors, such as the throttle sensor 68, the water temperature sensor 69, and the air flow meter 70, are connected to the input interface circuit 65 of the ECU 21 in the same manner, as the pressure sensor as described above. Based on the signals provided from these sensors, the ECU 21 executes various control operations such as fuel injection control, ignition timing control, and the failure detection operation, which is the primary function of the present invention.

Figure 4:
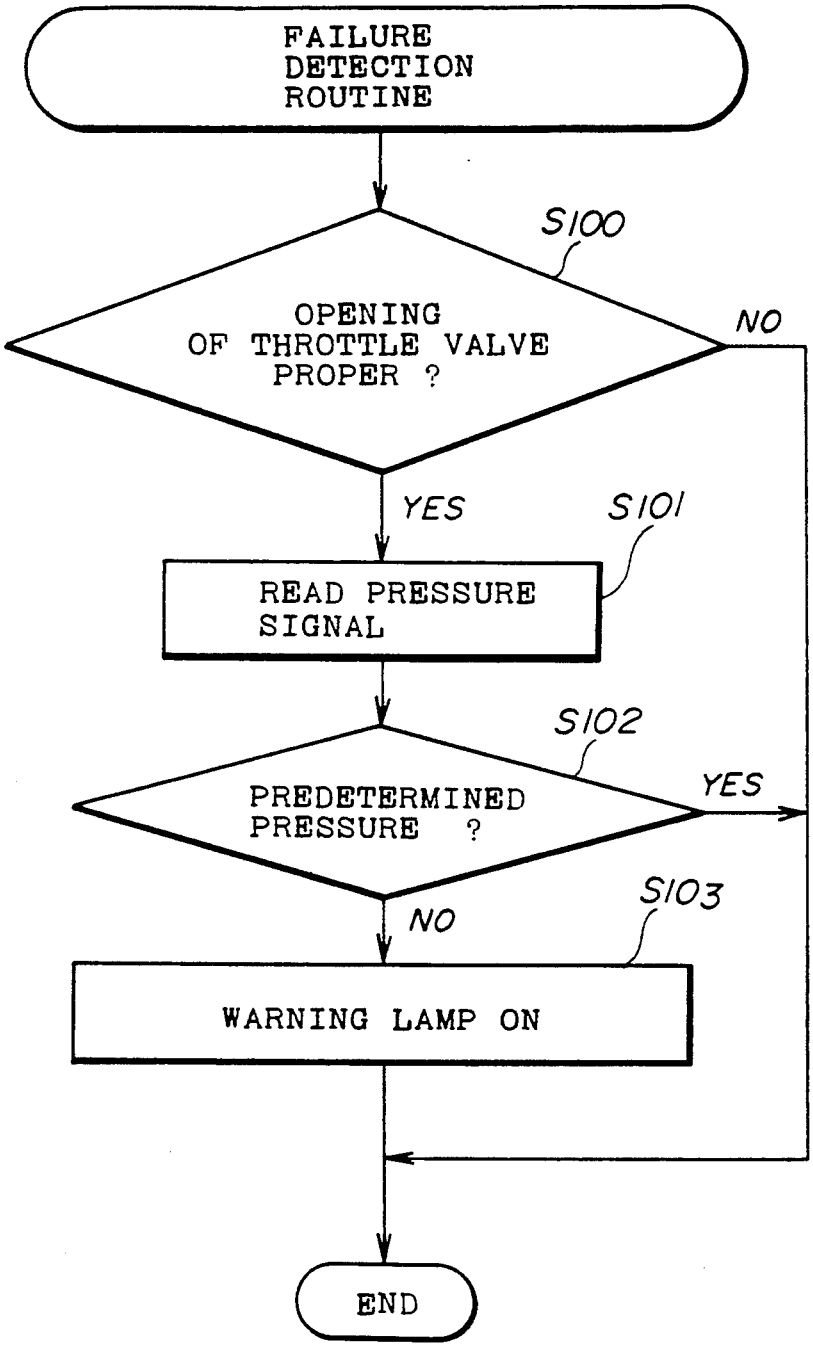
FIG. 4 is a flow chart for explaining the procedure of a failure detection routine executed by the ECU of the first embodiment.

When starting the routine shown in FIG. 4, it is judged in step 100 whether or not the opening of the throttle is appropriate for the failure detection, based on the throttle opening signal from the throttle sensor 68 (hereinafter step indicated as S). Then, in S100, if the opening of the throttle is not appropriate for the failure detection, the procedure is terminated and if the throttle is properly open, the procedure goes on to S101.

In S101, the pressure signal provided from the pressure sensor 17 is input to the ECU 21. Then in S102, it is judged whether or not the pressure in the vapor passage 12 is equal to a predetermined value, based on the pressure signal input in S101.

Now, assuming that there is no failure in the piping, and that the evaporative fuel purge system 20 is in a normal condition, the negative pressure applied to the purge passage 15 through opening of the throttle valve 16 is introduced to the vapor passage 12 via the bypass passage 18 and the orifice 19. However, when the evaporative fuel purge system 20 is not in a normal condition because of a crack or disconnection in the piping, the pressure detected by the pressure sensor 17 does not match the predetermined pressure determined based on the opening of the throttle valve because air leaks to the passages 12 or 15, or because the passage is clogged.

Since the vapor passage 12 and the purge passage 15 are communicated together, when a failure occurs in either the passage 12 or 15, the canister 11 or the fuel tank 13, the influence thereof will appear in both of the passages 12 and 15. Accordingly, only one pressure sensor is needed to detect the failure; it may be connected to either the vapor passage 12 or the purge passage 15, and the detection of failure of the evaporative fuel purge system can be done therewith. Therefore, a reduction of the number of components used, and simplification of construction may be obtained. Moreover, the program in the ECU 21 can be simplified because the program for the detection of failure is made to use a signal from only one pressure sensor.

On the basis of the failure detection procedure as mentioned above, if the ECU 21 judges that no failure is observed in the evaporative fuel purge system 20 and it finds, in S102, the pressure in the vapor passage 12 to be the predetermined pressure, it terminates the operation. On the other hand, if the pressure in the vapor passage 12 is found, in S102, not to be the predetermined pressure, operation proceeds to S103 wherein the ECU 21 has the warning lamp 22 turned on to alert the driver of the failure in the evaporative fuel purge system. As mentioned above, by employing a failure detection device 10 according to the present invention, detection of failure of the evaporative fuel purge system can be performed surely with simplified construction.

Figure 5:
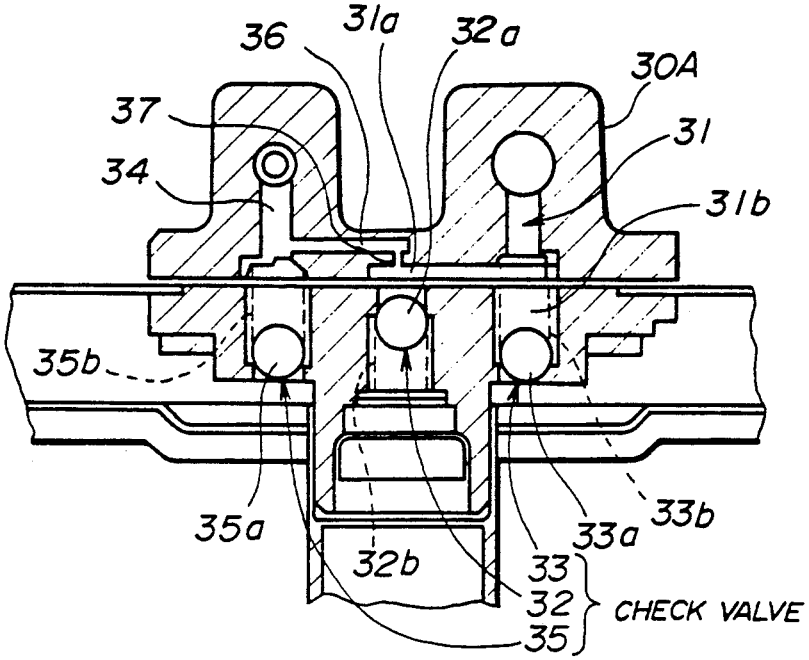
FIG. 5 is an enlarged sectional view of the upper portion of the canister employed in a second embodiment according to the present invention.
Figure 6:
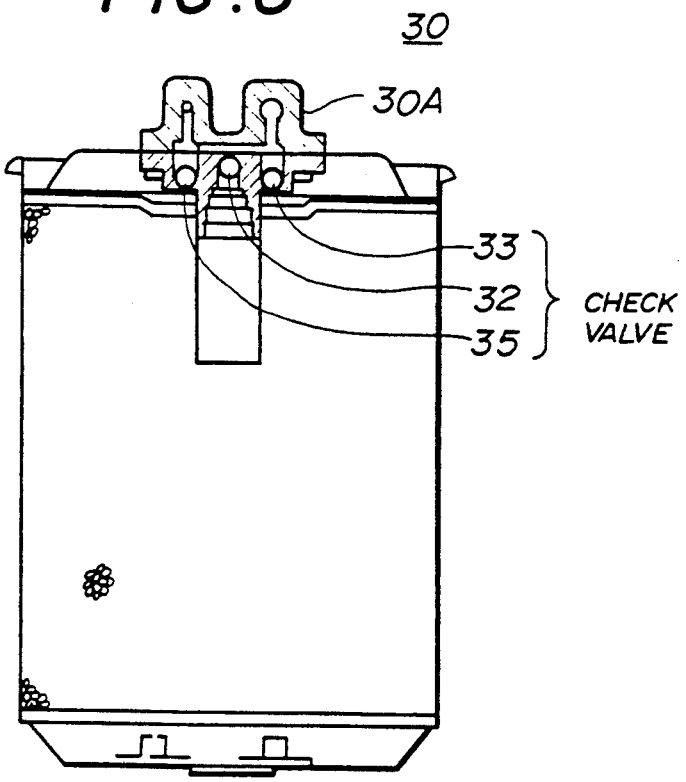
FIG. 6 is a view of the canister employed in the second embodiment according to the present invention.

FIG. 5 and FIG. 6 show the canister 30 employed in a second embodiment according to the present invention. As the construction of the failure detection device of the second embodiment is the same as that of the failure detection device 10 of the first embodiment shown in FIG. 1 except for the construction of the canister 30, the second embodiment will be explained with only detail of the canister 30.

In the failure detection device 10 of the first embodiment, the vapor passage 12 and the purge passage 15 are connected through the bypass passage 18 outside the canister 11. The failure detection device of the second embodiment features the vapor passage 12 and purge passage 15 being connected inside the canister 30.

FIG. 5 is an enlarged sectional view of the connection head 30A positioned in an upper portion of the canister 30, and FIG. 6 is an entire view of the canister 30. As shown in each figure, in the connection head 30A of the canister 30, a passage 31, to which the vapor passage 12 is connected, branches and forms a first and a second branch 31*a* and 31*b* respectively. Check balls 32*a* and 33*a* pushed by coil springs 32*b* and 33*b* respectively are placed inside these branches 31*a* and 31*b*. These check balls 32*a*, 33*a* and the coil springs 32*b*, 33*b* form the check valves 32, 33. The check valve 32 permits the fuel vapor from the fuel tank 13 to flow into the canister 11 by through motion of the check ball 32*a*, when the pressure of the fuel vapor from the fuel tank 13 exceeds the predetermined value. On the other hand, the check valve 33 permits the fuel adsorbed in the canister 11 to return to the fuel tank 13 by means of motion of the check ball 33*a*, when the pressure in the fuel tank 13 becomes lower than the predetermined negative pressure.

In the passage 34, formed in the connection head 30A of the canister 11 and connected to the purge passage 15, there is formed a check valve 35. When the pressure becomes lower than the predetermined negative pressure, the check valve 35 opens and the fuel in the canister 11 is purged to the intake line 14 via the purge passage 15.

The bypass passage 36 is formed between the passage 31, which is connected to the vapor passage 12, and the passage 34, which is connected to the purge passage. The orifice 37 is formed in a predetermined position in the passage 31 side of the bypass passage 36. By employing the canister 30 having the connection head 30A comprising the bypass passage 36 and the orifice 37 formed therein, construction of the piping above the canister 30 can be simplified in addition to realizing the same results as those of the first embodiment.

Figure 7:
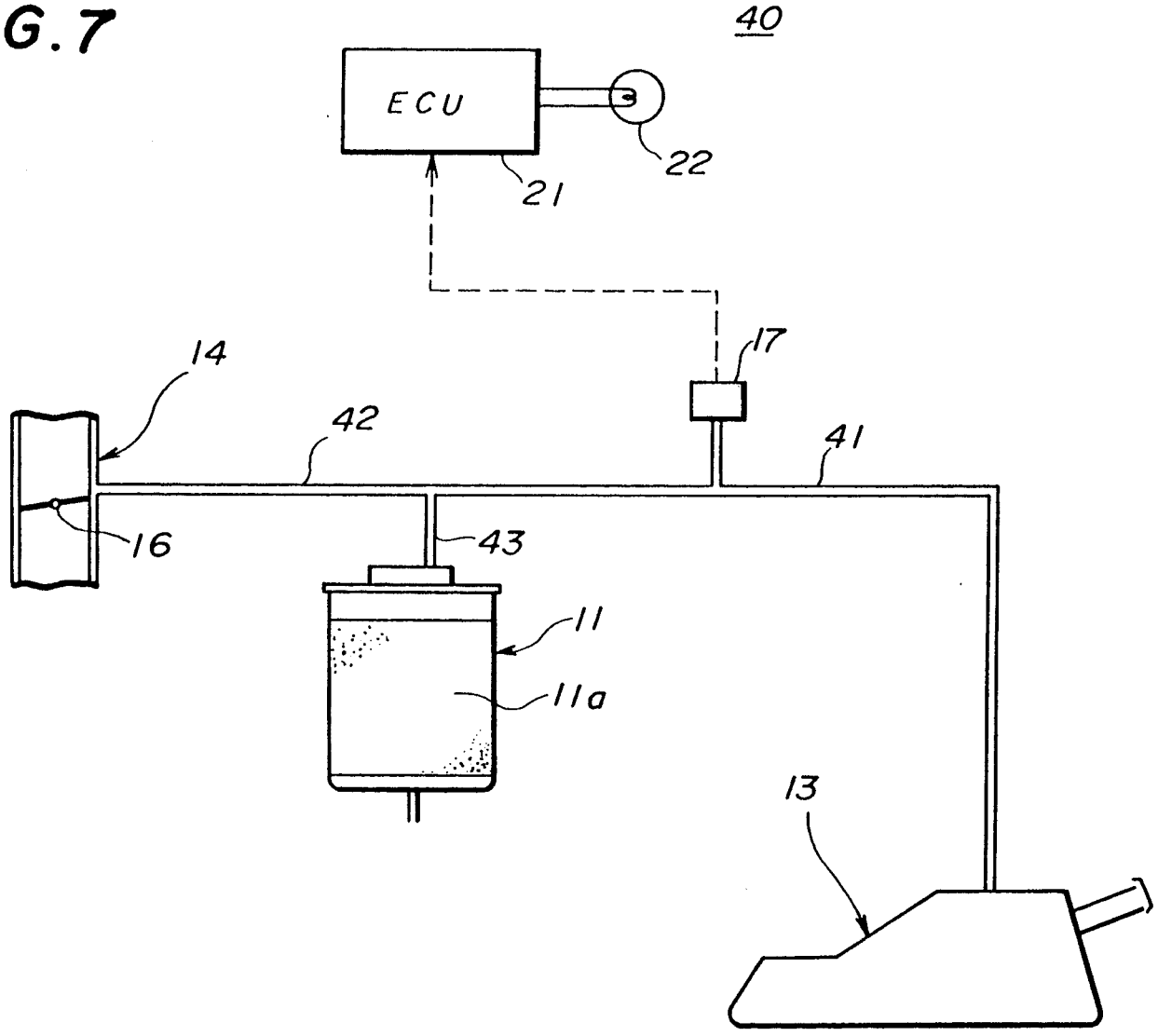
FIG. 7 is a view for explaining a third embodiment according to the present invention.

FIG. 7 shows a failure detection device 40 of a third embodiment of the present invention. In FIG. 7, those components that are the same as corresponding components in the failure detection device 10 of FIG. 2 are designated by the same reference numerals and a description thereof will be omitted.

In the failure detection device 40 shown in FIG. 7, a pipe 43 is commonly used as input passage of the vapor passage 41 and output passage of the purge passage 42. By this construction, a more simplified construction of the piping can be obtained.

Figure 8:
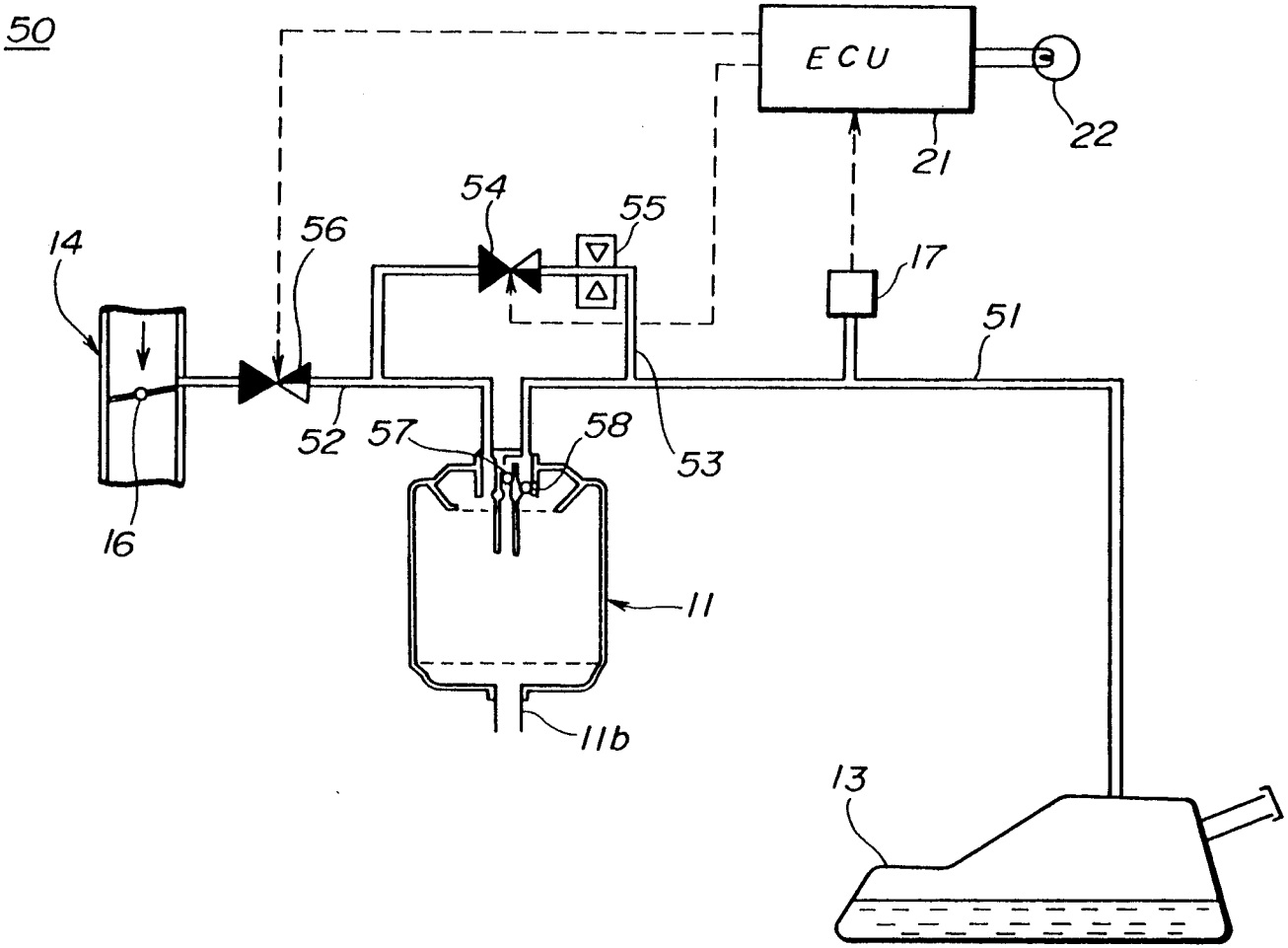
FIG. 8 is a view for explaining a fourth embodiment according to the present invention.

FIG. 8 shows a failure detection device of the fourth embodiment of the present invention. In FIG. 8, those components that are the same as corresponding components in the failure detection device 10 of FIG. 2 are designated by the same reference numerals and a description thereof will be omitted.

In the failure detection device 50, the vapor passage 51 and the purge passage 52 are independently connected to the canister 11, and the bypass passage 53 is provided between the vapor passage 51 and the purge passage 52. In this bypass passage 53, the bypass valve (hereinafter abbreviated VSV) 54, a solenoid valve, which closes when electricity is turned off and opens when electricity is turned on, and the orifice 55, which chokes the bypass passage 53, are provided. Additionally, the purge valve (hereinafter abbreviated VSV) 56, a solenoid valve, which controls the amount of fuel to be purged to the intake line 14, through the purge passage 52. These VSV 54 and VSV 56 mentioned above are controlled respectively by the control signal from the ECU 21.

The first check ball valve 57 is provided at the connecting portion of the vapor passage 51, in the canister 11, the valve opening when the pressure in the fuel tank 13 exceeds a predetermined positive pressure. And a second check ball 58 valve is provided which valve opens when the pressure inside the fuel tank 13 becomes a negative pressure as is the case once the fuel tank 13 is filled with fuel vapor and the fuel vapor becomes a liquid again upon cooling.

Accordingly, in the state where the VSV 54 is open, the first check ball valve 57 opens and allows the fuel vapor to be introduced to the canister 11 through flow through the vapor passage 51. Fuel vapor is adsorbed by the activated carbon in the canister 11 when the pressure inside the fuel tank 13 is increased by evaporation of large amount of fuel vapor. On the other hand, when the pressure inside the fuel tank 13 becomes lower than the predetermined negative pressure, the second check ball 58 moves and allows air to be introduced to the fuel tank 13 thus assuring durability of the fuel tank 13.

Even though the bypass passage 53 is provided between the vapor passage 51 and the purge passage 52, fuel vapor will not enter the purge passage 52 directly from the vapor passage 51 when the VSV 54 is close because the vapor passage 51 and the purge passage 52 are not communicated with each other.

As mentioned before, the ECU 21 is connected to VSV 54, VSV 56 and the pressure sensor 17. Furthermore, a water temperature sensor, which detects the temperature of the cooling water, an idle switch, which detects the state of idling, and tachometer, which detects the revolution speed of the engine, are also connected to the ECU 21.

Figure 9:
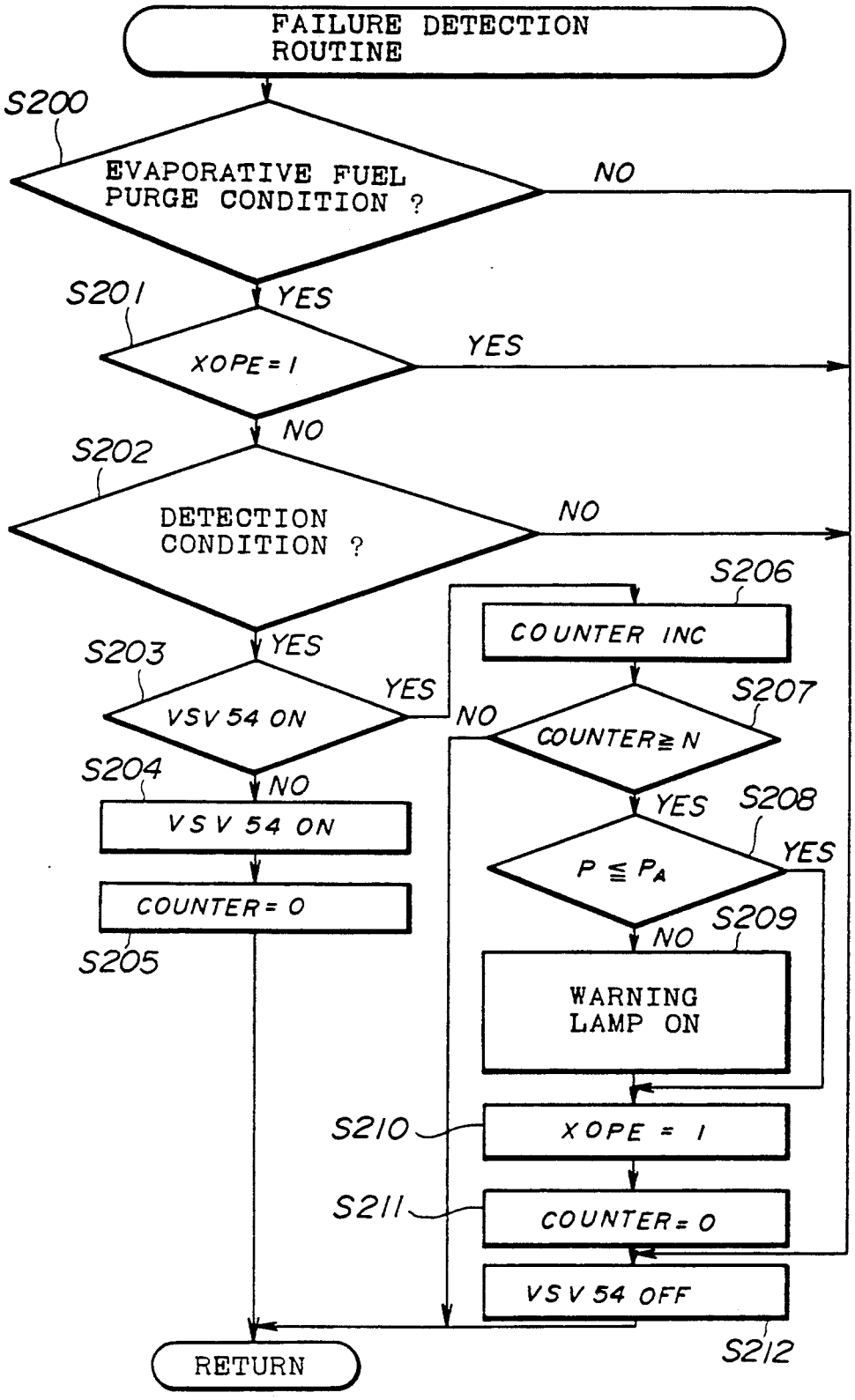
FIG. 9 is a flow chart for explaining the procedure of a failure detection routine executed by the ECU of the fourth embodiment.

Next, operation of the failure detection process executed by the ECU 21 will be explained. FIG. 9 is a flow chart showing the routine of the failure detection procedure executed by the ECU 21. This procedure is a routine executed repeatedly, for example, every 32 ms. The VSV 56 is always kept open by the ECU 21 during the failure detection procedure of the evaporative fuel purge system which procedure is explained hereinafter.

When the failure detection routine is started, the ECU 21 judges, in S200, whether or not the failure detection procedure is operational. This step is necessary because the failure detection procedure executed in the following steps is an operation to check whether or not the evaporative fuel purge system functions normally, accordingly, it has to be done under a condition where the evaporative fuel purge system is operational. Specific conditions of the evaporative fuel purging are, for example, that the water temperature is above a predetermined temperature, the idle switch is off, i.e. not in idling state, and that a learning process of the air-fuel ratio is not in active.

If it is judged, in S200, that the conditions are not suitable for the evaporative fuel purging, the operation proceeds to S212 where the VSV 54 is turned off because the state of the system is not suitable for operation of the failure detection process, then the operation ends.

On the other hand, if it is judged that the conditions are suitable for the evaporative fuel purging, operation proceeds to S201 where it is judged whether or not the failure detection has been done before. Specifically, XOPE, a flag of the completion of the operation, is checked to see if it is set (XOPE=1). This XOPE is set in S210 failure detection of the evaporative fuel purge system having been executed in S208 explained in the following. Accordingly, by checking the status of the XOPE it is judged whether or not the failure detection has been executed in the past.

The reason for checking the execution of the failure detection mentioned above is that if the failure detection is executed at least once during operation of the engine, safety will be assured because causes of failure are mostly cracks or a disconnection of the piping.

Therefore, if it is judged that the failure detection of the evaporative fuel purge system has been executed (XOPE=1 in S201), operation proceeds to S212 where the VSV 54 is opened, and then the procedure ends.

On the other hand, if it is judged that the failure detection has not been executed in the past (XOPE=0 in S201), operation proceeds to S202. In S202, it is judged whether or not the conditions are suitable for the failure detection routine. A suitable condition for the failure detection routine is, for example, the engine speed, the negative pressure in the intake line etc., being within the predetermined range. In other words, there is a possibility that an accurate failure detection of the evaporative fuel purge system can not be performed while the engine speed and the negative pressure in the intake line are fluctuating outside a predetermined range. Because of that, when an unstable state, the engine speed or the negative pressure in the intake line fluctuates outside the predetermined range, the failure detection is not to be executed and, in this case, operation proceeds to S212 where the VSV 54 is opened and the operation ends.

On the other hand, if it is judged, in S202, that the condition is suitable for operation of the failure detection, the operation proceeds to S203, and checks whether or not the VSV 54 positioned in the bypass passage 53 is open.

As explained before, the vapor passage 51 and the purge passage 52 are required to be connected in order to perform the failure detection with only one pressure sensor 17, thus making the construction of the failure detection device more simple. It is necessary for the VSV 54 to be open during the operation of the failure detection. Therefore, when it is judged that the VSV 54 is closed in S203, it opens in S204. After the VSV 54 is opened, the counter, explained hereinafter, will be reset (COUNTER=0) in S205 following, and then the first routine ends.

On the other hand, in the second or a later routine, if it is judged that the VSV 54 is open, the operation proceeds to S206 where the counter is incremented. In the following S207, it is judged whether or not, this incremented counter is equal to or more than the predetermined value N. If the judgement in S207 is negative, the operation ends without executing S212. Accordingly, even in case the judgement in S207 is negative, the VSV 54 remains in the open state.

If it is judged that the counter is equal to or more than the predetermined value N, the operation proceeds to S208 and it is judged whether or not the pressure value P exceeds the predetermined pressure value $P_A$.

The reason that the failure detection in S208 is not executed until the counter becomes equal to or more than a predetermined value N in S206 and S207 is that the pressure in the vapor passage 51, the purge passage 52, and the bypass passage 53 fluctuates for a short time after the VSV 54 is opened. If the failure detection is performed under conditions where the inside pressure is not uniform, accurate failure detection will not be performed. Therefore, by executing S206 and S207, allow a predetermined period of time N elapses, so as to the pressure inside the vapor passage 51, the purge passage 52, and the bypass passage 53 to become uniform, so that accurate failure detection can be obtained.

In S208, if the pressure value P from the pressure sensor 17 does not exceed a predetermined pressure value $P_A$, the evaporative fuel purge system is determined not to have a failure such as leaking, and a operation proceeds to S210 without executing a warning process. If, however, the pressure value P from the pressure sensor 17 exceeds the predetermined pressure value $P_A$, it is judged that there exists a failure such as leaking somewhere in the evaporative fuel purge system, and the warning lamp 22 is turned on in S209 to alert the driver that a failure has occurred.

After the failure detection step in S208 is completed, XOPE, is set (XOPE=1). Then, in the following S211, the counter is reset (COUNTER=0) and the VSV 54 is closed in S212 and operation ends.

As is apparent from the previous explanation of the operation, the failure detection device 50 of this embodiment comprises the vapor passage 51 and the purge passage 52 being separated by closing of the VSV 54 at times other than the failure detection time, and opening the VSV 54 when executing the failure detection procedure.

Therefore, the failure detection for the entire evaporative fuel purge system can be done by having only one pressure sensor 17 because the vapor passage 51 and the purge passage 52 are connected during the failure detection so that the construction of the failure detection device can be simplified.

Further, evaporation of excess fuel vapor can be prevented because the pressure inside the fuel tank 13 can be maintained at a predetermined pressure since fuel vapor evaporated in the fuel tank 13 is not allowed to flow directly into the purge passage 52 as the vapor passage 51 and the purge passage 52 are separated and thus independent.

Not shown in FIG. 9, the VSV 54 is opened at the time the engine is stopped. Accordingly, the pressure inside the fuel tank 13 becomes the atmospheric pressure, since the fuel tank 13 is connected to the outside via the vapor passage 51, bypass passage 53, the canister 11, and the canister opening 11*b*. Therefore, leaking of the fuel vapor to the atmosphere can be minimized when a piping comprised by the evaporative fuel purge system has a crack or the like. On the other hand, while the engine is running (except during the failure detection), the VSV 54 is open so as to maintain the pressure inside the fuel tank 13 at the predetermined pressure so that evaporation of the fuel vapor can be controlled.

The XOPE, is reset (XOPE=0) when the engine is stopped.

The amount of fuel vapor flowing into the purge passage 52 from the vapor passage 51 can be controlled to be a minimum when the VSV 54 is turned to open, as the orifice 55 is provided to the bypass passage 53. Therefore, there is no possibility that fluctuation of the air-fuel ratio of the mixture suctioned by the engine affects the operation of the engine during the operation of the failure detection.

In a fourth embodiment, a check ball is not provided to the purge passage 52 of the canister 11. So a portion of the negative pressure is released to the atmosphere through the canister opening 11*b*. In other words, only a negative pressure generated by the resistance of the canister 11 is applied to the system. Additionally, since the orifice 55 is provided to the bypass passage 53, negative pressure applied to the upstream side of the orifice 55 (the fuel tank 13 side) is reduced.

Therefore, the fuel tank 13 will not be overloaded because the negative pressure applied to the fuel tank 13 is minimized, and the acceleration of evaporation of the fuel, which is caused by the negative pressure applied to the fuel tank 13, will be prevented. In this condition, the upstream side of the orifice 55 becomes a nearly static pressure-system, so that no negative pressure is applied to this upstream side. Accordingly, the failure detection can be done with only a small negative pressure.

Figure 10:
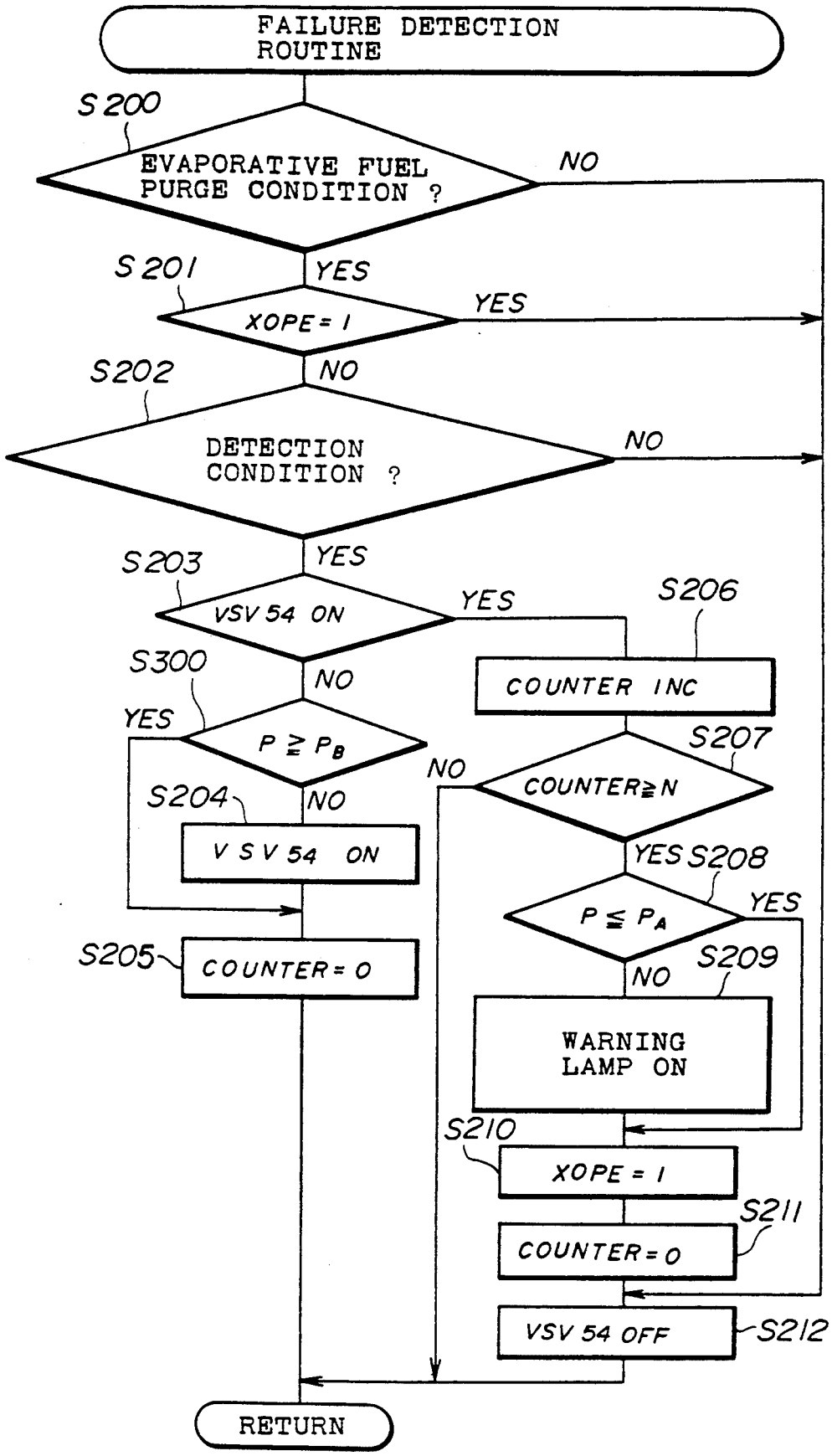
FIG. 10 is a flow chart for explaining the procedure of a failure detection routine executed by the ECU of the fifth embodiment.

FIG. 10 is a flow chart for explaining the operation of a fifth embodiment according to the present invention. This consecutive routine is repeatedly started, for example, every 32 ms. The construction of this embodiment is the same as that of the fourth embodiment mentioned above and a description thereof will be omitted with exceptions detailed below.

The failure detection routine of this embodiment has an additional S300 between S203 and S204 of the routine of the fourth embodiment. Since other steps are the same as in the fourth embodiment, steps which are the same as those in FIG. 9 are designated by the same reference numerals and description is given hereinafter.

Referring to FIG. 10, when the failure detection routine proceeds from S200 to S203, it is judged whether or not the VSV 54 is open (on).

However, since the VSV 54 is closed (off) by starting of the engine and it is open when the engine is stopped, the SVS 54 is in a closed state before the operation of the failure detection. So the VSV 54 is judged to be off in S203, and the pressure P detected by the pressure sensor 17 (actually this indicates the pressure inside the fuel tank) is judged for whether or not it is larger than the predetermined set pressure $P_B$ in S300. The set pressure $P_B$ above is, for example, 10 mmHg which is a smaller positive pressure than that at which the check ball valve 58 turns to open.

In S300, if $P<P_B$, it is judged that the amount of fuel vapor is small and the VSV 54 is turned on, so as to start the failure detection by steps S206~S208, and clear the counter in S205, then the routine ends.

On the other hand, if $P \geqq P_B$ in S300, it is judged that the amount of fuel vapor is large and the routine proceeds to S205, where the counter is cleared and then the routine ends. Therefore, until the judgement that $P<P_B$ is obtained in consequent procedures, the failure detection will not be executed. According to this, an error of the failure detection caused by a generation of a large amount of fuel vapor in the fuel tank 13.

In case $P<P_B$ in S300 and the routine is started again after that, the routine proceeds to S206 this time and then to S212 because the VSV 54 is judged to be on in S203.

According to this embodiment, when it is judged that a large amount of fuel vapor is generated in the fuel tank 13, the operation of the failure detection is stopped without turning the VSV 54 on, so that a detection error due to generation of a large amount of fuel vapor in the fuel tank 13 can be eliminated, and so that contamination of the exhaust emission can be prevented in addition to the desired results of the fourth embodiment described above.

Furthermore, although the VSV 56 is provided to the purge passage 52 in the fourth and the fifth embodiment in order to control the amount of the fuel purged to the intake line 14, it is obvious that a VSV can be provided to a purge passage to obtain the same effect in other embodiments. It is also obvious that the results of the present invention will be obtained if the VSV 56 is eliminated from the purge passage 52 in the fourth embodiment.

The present invention is not limited to the specifically disclosed embodiments, and variations may be made without departing from the scope of the present invention.

What is claimed is:

1. A failure detection device for an evaporative fuel purge system for an internal combustion engine comprising:

a canister for containing an adsorbent for adsorbing a fuel vapor;

a vapor passage connecting the canister to a fuel tank, for introducing a fuel vapor in the fuel tank to the canister;

a purge passage connecting the canister to an intake line of the internal combustion engine for introducing the fuel vapor adsorbed by the adsorbent in the canister to the intake line;

a bypass passage for directly connecting the vapor passage and the purge passage;

detection means provided in one of the purge passage and the vapor passage for detecting the pressure therein; and judging means for judging that a failure has occurred when the detection means detects a pressure higher than a predetermined pressure while the fuel vapor is purged to the intake line of the internal combustion engine.

2. A failure detection device as claimed in claim 1, wherein an orifice having a high fluid resistance is additionally provided to said bypass passage, and said detecting means is connected to said vapor passage.

3. A failure detection device as claimed in claim 1, wherein said canister comprises a connection head having said bypass passage therein, the bypass passage being connected to said vapor passage and said purge passage.

4. A failure detection device as claimed in claim 3, wherein said connection head comprises first and second check valves, the first check valve being positioned in the portion of the connection head connecting to said vapor passage and the valve opening when the pressure of the fuel vapor flowing in from said fuel tank is equal to or higher than a first predetermined pressure, the second check valve being positioned in the portion of the connection head connecting to said vapor passage, and the second check valve opening when the pressure inside said fuel tank is equal to or lower than a second predetermined pressure.

5. A failure detection device as claimed in claim 3, wherein said connection head comprises a check valve positioned in the portion of the connection head connecting to said purge passage and the check valve opening when the pressure inside said purge passage is equal to or lower than a predetermined pressure.

6. A failure detection device as claimed in claim 1, wherein a purge valve controlled to open and close by a signal from said judging means is additionally provided to said purge passage.

7. A failure detection device as claimed in claim 1, wherein a bypass valve controlled to open and close by a signal from said judging means is additionally provided to said bypass passage.

8. A failure detection device as claimed in claim 7, wherein said judging means executes the failure detection when a predetermined time has passed after said bypass valve is opened.

9. A failure detection device as claimed in claim 7, wherein said judging means opens said bypass valve only when the failure detection procedure is executed.

10. A failure detection device as claimed in claim 1, wherein warning means controlled by said judging means and operated when a failure is detected by said judging means is additionally provided.

11. A failure detection device as claimed in claim 7, wherein said judging means does not execute the failure detection procedure when the pressure inside said fuel tank is equal to or higher than a predetermined pressure.

* * * * *

UNITED STATES PATENT AND TRADEMARK OFFICE

CERTIFICATE OF CORRECTION

PATENT NO. : 5,245,973

DATED : September 21, 1993

INVENTOR(S) : Takayuki OTSUKA, et al.

It is certified that error appears in the above-indentified patent and that said Letters Patent is hereby corrected as shown below:

Column 1, line 47, change "can not" to --cannot--.

Column 1, line 49, change "extending" to --extends--.

Column 2, line 9, change "systems" to --system--.

Column 4, line 2, change "lead" to --led--.

Column 7, line 49, change "in active" to --inactive--.

Column 8, line 62, delete "allow".

Column 8, line 63, after "so as to" insert --allow--.

Column 9, line 2, change "a opera" to --an opera--.

Column 10, line 45, before "caused" insert --is--.

Signed and Sealed this

Twelfth Day of September, 1995

*Attest:*

Bruce Lehman

BRUCE LEHMAN

*Attesting Officer*

*Commissioner of Patents and Trademarks*